United States Patent [19]

Emmons

[11] Patent Number: 4,793,162

[45] Date of Patent: Dec. 27, 1988

[54] METHOD FOR REPAIRING FAILED WATERSTOPS AND PRODUCTS RELATING TO SAME

[75] Inventor: Peter H. Emmons, Gaithersburg, Md.

[73] Assignee: SPT, Inc., Baltimore, Md.

[21] Appl. No.: 894,104

[22] Filed: Aug. 7, 1986

[51] Int. Cl.[4] ..... E02B 15/04

[52] U.S. Cl. ..... 404/69; 404/72; 52/514; 52/743; 156/71; 156/78; 156/94

[58] Field of Search ..... 404/49, 69, 72; 156/78, 156/79, 71, 94; 52/309.4, 403, 395, 396, 514, 743, 309.8, 309.1, 309.12; 264/35, 261; 428/280, 290, 413

[56] References Cited

U.S. PATENT DOCUMENTS

| | | | |
|---|---|---|---|
| 1,883,196 | 10/1932 | Wertz | 52/514 |
| 2,187,324 | 1/1940 | Many | 52/743 |
| 2,229,264 | 1/1941 | Wertz | 52/743 |
| 3,172,237 | 3/1965 | Bradley . | |
| 3,434,401 | 3/1969 | Kiewit . | |
| 3,461,781 | 8/1969 | Weiner et al. . | |
| 3,555,982 | 1/1971 | George | 404/69 |
| 3,558,421 | 1/1971 | Hartzell et al. | 428/413 X |
| 3,581,450 | 6/1971 | Patry | 52/403 |
| 3,706,264 | 12/1972 | Hurst . | |
| 3,708,930 | 1/1973 | Stegmeier . | |
| 3,713,368 | 1/1973 | McDowell et al. . | |
| 3,724,155 | 4/1973 | Reeve . | |
| 3,867,492 | 2/1975 | Drostholm | 156/71 X |
| 3,903,587 | 9/1975 | Boiardi . | |
| 3,956,557 | 5/1976 | Hurst . | |
| 3,977,802 | 8/1976 | Galbreath . | |
| 4,033,702 | 7/1977 | Moerk, Jr. . | |
| 4,041,665 | 8/1977 | de Munck . | |
| 4,084,912 | 4/1978 | Pyle et al. . | |
| 4,111,583 | 9/1978 | Brady et al. | 404/69 |
| 4,127,350 | 11/1978 | Weber . | |
| 4,352,262 | 10/1982 | Edelmann et al. | 52/514 X |
| 4,371,283 | 1/1983 | Lampertz . | |
| 4,460,737 | 7/1984 | Evans et al. . | |
| 4,470,719 | 9/1984 | Dziark et al. | 52/514 X |
| 4,608,300 | 8/1986 | Gruber | 428/413 X |
| 4,659,748 | 4/1987 | Boddie | 404/69 X |

OTHER PUBLICATIONS

Michael Roberts, Research Disclosure No. 19530, "Repair of Joints and Large Cracks in Highways," Jul. 1980.

Structural Preservation Systems, Inc., Dwg. No. 1515-2 (1983).

"The Guidebook to Concrete Repair", Structural Preservation Systems, Inc., 1981.

*Primary Examiner*—Robert A. Dawson
*Assistant Examiner*—Jeff H. Aftergut
*Attorney, Agent, or Firm*—Nixon & Vanderhye

[57] ABSTRACT

A waterstop repair method and structure for use in both new and existing concrete structures in which a reinforced neoprene diaphragm is anchored to the concrete structure using corrosion-resistant anchors, fiberglass hold-down strips and polyester felt adhesive strips saturated with epoxy adhesive. The diaphragm is supported by a pressure injected hydrophylic urethane foam which is pumped beneath the diaphragm which thereby provides support for the diaphragm and fills the interstices of the existing concrete joint to prevent water leakage in and around a failed waterstop and to thereby form an integral, water-tight structure for new and existing concrete joints.

30 Claims, 4 Drawing Sheets

METHOD FOR REPAIRING FAILED WATERSTOPS AND PRODUCTS RELATING TO SAME

FIELD OF THE INVENTION

The present invention relates to a method for repairing previously-installed waterstops and to an improved waterstop design for use in both new and existing concrete structures. More particularly, the waterstop designs and methods in accordance with the invention may be used to repair failed waterstops disposed between adjacent concrete panels to thereby provide a joint which is water-tight when exposed to head pressure on either side of the waterstop, and which more effectively accommodates the expansion, contraction and shearing forces in the void areas between concrete panels. The present method of repair is particularly useful for poured concrete foundations, building walls, support structures, reservoirs, and for water retaining structures such as poured concrete basins, tanks, conduits, tunnels, pipelines, retaining walls and other constructions in which a plurality of concrete sections or panels are joined to form the completed structure.

BACKGROUND OF THE INVENTION

In the construction of concrete building foundations, roadways, support members and the like, particularly those having steel reinforcing, it is often necessary to pour different portions of the concrete at different times, or to connect a new concrete wall or foundation to an older structure. In such cases, the second concrete portion abuts against the surface of the first pour. In both new and old constructions, ambient temperature fluctuations inevitably cause increases or decreases in concrete volume and consequent changes in the joint openings. As new concrete dries, it also sets and shrinks relative to the previously-poured concrete leaving a crack or space through which water can travel.

In order to prevent the unwanted passage of water through abutting joints of concrete, it is well known to use one or more waterstops in order to seal the various concrete joints in the foundation. An early variety of such waterstops used copper and steel plates in cooperative engagement between adjacent slabs. More recent waterstop designs consist of sealing elements made of an elastic deformable material with or without integral elastic and/or metal anchoring portions which are installed in the newly-poured concrete to seal the joints.

Concrete foundations for large water reservoirs or water storage tanks are often poured using a plurality of adjacent concrete slabs separated by one or more different types of waterstop constructions. Large concrete support structures, building floors and the like are also poured in sections or "panels" with expansion joints and/or waterstops dispersed throughout the structure. Certain waterstops (typically referred to as "expansion-type") are specifically intended to seal the concrete joints while at the same time permitting expansion and contraction of the adjacent panels. Other "labyrinth" type constructions are not used in applications requiring thermal expansion and contraction. Nevertheless, the present invention relates to both categories of previously-installed waterstop devices.

In prior art constructions, waterstops of elastic material are generally characterized as "passive" in nature. A typical passive waterstop design is illustrated in U.S. Pat. No. 3,172,237 and consists of a flat strip of elastic material which is partially embedded in the first concrete pour and projects outwardly from one end of the concrete. Usually, in order to install such waterstops, the form for the concrete must contain a longitudinal slit along one end to allow the flat strip portion of the waterstop to project outwardly. The concrete for the second section is then poured with the projecting portion embedded in the new concrete.

Most conventional waterstop designs use anchoring means in the form of ribs or the like along their edges to ensure proper anchoring in the adjacent panel sections. Often, however, during the second pour, the projecting portion of the strip becomes flattened and/or displaced from its proper position and thus will not be properly anchored in the new concrete. Ultimately, poor anchoring results in failure or the propagation of cracks at or near the waterstop which then permit water to seep through the joint foundation. For certain water storage facilities, such as a water tank for a large metropolitan community, even a small amount of leakage through a failed or damaged waterstop can result in substantial water losses or the contamination of potable water in ground water sources over a period of time. Further, the repair of such waterstops generally requires that the entire facility be taken out of service to perform the necessary repairs to the foundation.

One distinct disadvantage of conventional waterstop constructions is that the newly-poured concrete panels shrink during curing, thereby causing the embedded flanges to pull away from the surrounding concrete matrix. As a result, the flanges of prior waterstops often become loose before the concrete panels are completely set. Even after installation, the repeated expansion and contraction of adjacent panels of concrete (due to ambient temperature fluctuations) causes the embedded flanges to loosen to the point they permit water to flow around their edges.

Thus, the principal problem encountered with passive (expansion-type) waterstop devices is that they do no adequately provide for shearing movement—that is, relative lateral motion between adjacent panels or between the floor and side walls of structures due to unequal exposure to extremes of temperature. The latter situation exists, for example, in the case of a concrete storage tank where expansion and contraction of the concrete side walls due to changes in temperature result in expansion and contraction of the diameter of the tank, but no comparable change in the floor or footings on which the walls rest. Even when properly installed, conventional waterstops may not effectively accommodate the shearing forces which exist within the structure simply because the two faces of the waterstop are anchored to different concrete panels. Such problems in anchoring are particularly acute for joints at the corners and angled intersections between panels which require matching waterstop configurations. During normal expansion and contraction, the waterstop may be subjected to severe shearing stresses along the intermediate portion between concrete sections, resulting in cracks or failure of the waterstop even before the foundation is completed. After installation, the waterstops are subjected to constant expansion and contraction and, under normal conditions, the "bulb type" elastic material may become over-extended and tear, or the anchor portions may become dislodged or fail completely. In addition, over an extended period of time, the contact pressure between the anchors and the concrete may leave a large potential area of leakage, especially in regions where the waterstop is embedded in an imperfect concrete matrix.

In applications in which the concrete joints are subjected to outside water pressure (such as tunnels or enclosed chambers), debris and solid particulates may penetrate the joint and eventually contribute to the leakage and/or distortion of the waterstop in its installed position. Even when new waterstops are installed, care must be taken not to permit debris or foreign materials to fall into the concrete joint since their presence may cause the waterstop to fail.

The installation of bulb type waterstops is also cumbersome and costly. As indicated above, the conventional practice for installing such waterstops requires that the mold form be split or, alternatively, that the form be recessed to accommodate the non-embedded-portion of the waterstop. In either case, the procedure is expensive and time consuming, primarily because the joint is totally inaccessible for repair without removing or dismantling the entire concrete structure. Thus, it is essential that a waterstop in a newly-installed structure perform satisfactorily, particularly "expansion"-type waterstops which must accommodate the shearing forces between adjacent joints.

A number of prior methods have attempted to repair existing waterstops. For example, sealants, such as epoxy gels or elastomeric compounds have been used to seal joints between construction panels or slabs of concrete in order to make the joint "waterproof". Generally, the sealant has been applied by injection between adjacent concrete slabs and then coating the joint with a tape or sheeting material. However, such sealing techniques have not been satisfactory primarily because the sealants are highly sensitive to moisture and require very dry surface conditions to ensure proper adhesion over the joint area. Also, the repair procedure is time consuming and expensive and does not provide a permanent water-tight seal capable of handling head pressure or the normal expansion and contraction of adjacent panels.

The known repair methods of injection are also ineffective for preventing the propagation of leaks in foundations which are subjected to hydrostatic pressures over prolonged periods of time such as, for example, a water storage vessel. In addition, the conventional methods of repair cannot be used for water storage facilities in which the concrete joint is subjected to both positive and negative water pressure, i.e., head pressure on one or both sides of the joint. "Negative" head pressures exist when the water pressure on one side of a concrete joint is greater than on the other side. If the waterstop is subjected to pressure on one side, it tends to "balloon out" in one direction over a period of time and thereafter will not effectively prevent leakage due to pressure on the opposite side. In other cases using the conventional sealant repair technique, care must be exercised not to smear the sealant on adjacent surfaces of the concrete. Thus, an additional time consuming procedure of masking the adjacent surfaces may be required.

Other repair techniques use a modified form of expansion joints in order to minimize the effects caused by thermal expansion and contraction. Often, a bituminous material will be injected or positioned in the slot between the concrete slabs. Invariably, however, foreign matter, such as dirt, small rocks, water and the like, become lodged in the crack and tend to loosen the joint due to cycles of expansion and contraction. Another disadvantage of bituminous materials is that they are not flexible and, during normal expansion and contraction, cause the cracks to fill with extraneous material resulting in additional unwanted expansion and/or water leakage.

SUMMARY OF THE PRESENT INVENTION

The improved waterstop construction and repair method in accordance with the present invention substantially eliminates the above problems with conventional waterstop designs and the expense associated with the retrofitting and repair necessary when conventional waterstops fail. In particular, the present invention provides a unique method for preventing the circuitous flow of water through failed waterstops in existing concrete structures. For most new concrete foundations, the claimed method also eliminates entirely the need for conventional bulb-type waterstops.

The waterstop structure and repair system in accordance with the present invention may be surface mounted or recessed into the concrete, depending on the particular field requirements. For applications involving the repair of water tank foundations, reservoirs and the like, the system may be designed to handle any desired hydrostatic pressure (or a range of pressures) for the specific structure being repaired or installed. The hydrostatic pressure may be either positive or negative (or both), again depending on the application in question. Thus, the present invention is particularly useful in applications such as tunnels in which the concrete joint may be subjected to water pressure from the outside or, depending on the structure, from both sides of the concrete joint.

The major component in the method and structure in accordance with the invention is a flexible reinforced neoprene-nylon diaphragm which is anchored to the concrete structure through the use of corrosion resistant anchors, fiberglass hold-down strips and epoxy adhesives. The diaphragm is supported by a pressure injected hydrophilic urethane foam which is pumped under pressure beneath the diaphragm as one of the final steps in the installation process. The pressurized foam provides support for the diaphragm and travels wherever a water passage exists in the concrete joint being repaired (or installed). As indicated above, such passages often extend as far down as the waterstop, around a failed section of the waterstop or into the intersecting cracks. Thus, the hydrophylic foam turns corners to intersect all existing joints in the concrete slab.

Once injected, the foam also reacts with any existing water within the concrete joint, thereby expanding and improving the sealing function of the foam at all concrete intersections. Significantly, and in contrast to the prior art methods of repair, the injection can be made in a damp environment. Preferred foam compositions for use in the present invention include conventional polyurethane grout materials (with or without an accelerator compound) which are hydrophilic in nature—that is, expand by chemically reacting with the water. A typical example of a suitable foam material for use in the invention are the "Flex 44" polyurethane foam compounds manufactured by De Neef America, Inc.

The preferred diaphragm members in accordance with the invention include a wide variety of rubber or elastomeric compounds and may comprise rubber alone or fabric supported rubber, i.e., an elastomeric rubber compound having a fabric reinforcing material impregnated therein. The fabric strengthens the diaphragm and permits a design having low thickness, but with the high strength, puncture resistance and flexibility necessary for use in the present invention. One preferred embodiment—the "neoprene-nylon diaphragm" referred to above utilizes a neoprene elastomer with a nylon fabric imbedded in the elastomer. The choice of an appropriate elastomer, diaphragm and fabric will depend on the specific waterstop repair in question. Typical examples of preferred elastomers include polyacrylate, chloro-sulfonated polyethylene, co-polymers of vinylidene fluoride and hexafluoropolypropylene, neoprene chloroprene, polysiloxane polymer, Buna N butadiene, acrylonitrile, butyl isobutylene isoprene, fluorosilicone and epichlorohydrin compounds. Typical examples of fabrics which may be used in diaphragm according to the present invention include those containing fibers consisting of aramid (e.g. Dupont Kevlar and Nomex), polyamides (Nylon), polyesters (Dacron) and various polyester/cotton blends.

The repair system in accordance with the invention also has an inherent redundant feature in that it ensures that water will not penetrate or circumvent the waterstop even if one part of the structure fails. For example, if the flexible diaphragm (which provides a mechanical seal over the concrete joint ) becomes punctured or otherwise fails, the injected foam sealant will continue to prevent leakage through the waterstop. This redundant nature of the present invention is particularly important in preventing failure when the waterstop is subjected to unusually high hydrostatic conditions or the shearing forces generated by ambient temperature fluctuations. Thus, the design allows for movement in the concrete joints without compromising the ability of the waterstop to prevent water leakage.

In essence, the method according to the present invention includes the steps of removing unsound concrete on the surface areas which will support the waterstop repair structure; cleaning the surface contact areas for the structure using high pressure water blasts, sand blasts or mechanical scarification; drilling one or more holes in the concrete slab to receive stainless steel expansion anchors for anchoring and securing the repair structure to the concrete; drilling diagonal holes which intercept the joint opening between the concrete slabs to create a "grout hole" connecting the slabs; removing all dust generated by the drilling operation and installing a polyester felt adhesive strip on adjacent sides of the two concrete slabs; pouring a two-component "self-leveling" conventional epoxy adhesive into the polyester felt until it becomes saturated with adhesive; installing a neoprene-nylon diaphragm onto the adhesive strip by way of solvent wiping contact between the polyester and neoprene surfaces; positioning fiberglass hold-down bars onto the neoprene-nylon diaphragm; inserting stainless steel expansion anchors into the pre-drilled holes and tightening until excess resin is exuded from the diaphragm/concrete interface; injecting hydrophilic urethane foam into the grout hole beneath the neoprene diaphragm under sufficient pressure to ensue full penetration of the foam cavity into the joint recesses; and finally, installing a polymer "nosing" on each side of the joint.

In an alternative embodiment of the present invention, the entire repair structure is recessed below the top surface of the abutting concrete joints being repaired, thereby eliminating the need for a polymer nosing.

In a third embodiment according to the invention, the waterstop repair structure is installed between adjacent concrete panels by initially removing a portion of the concrete panels to form a groove of fixed dimension along the top portion of the concrete joint. A first adhesive felt strip is inserted in the groove, followed by installation of a perforated neoprene diaphragm which is draped into the groove and worked into the adhesive felt strip. A second felt adhesive strip is applied to the top side portions of the neoprene member and a pair of right-angle fiberglass hold-down bars are positioned over the top of the diaphragm. The vertical side portions of the hold-down bars extend into the preformed joint groove while the top flange portions rest on the top surfaces of the neoprene diaphragm. The entire structure is anchored securely into position using expansion anchors, and hydrophilic foam is injected below the diaphragm as described above. Finally, a section of solid ethylene vinyl acetate foam is cut to length and adhesively installed inside the groove cavity directly above the center portion of the neoprene diaphragm. This additional solid foam insert serves to further protect the neoprene member and the existing waterstop and is particularly suited for applications in which the water above the waterstop contains solid particulates.

Surprisingly, it has been found that the pressurized injection of the urethane foam in accordance with the repair method of the present invention forces foam into even the smallest void areas in and around the existing waterstop and provides a cushioning effect between adjacent panels. The cushioning does not detract from the formation of a water-tight seal and, in fact, permits the diaphragm to flex slightly, depending on the head pressure or movement of the concrete joint. Thus, the foam uniformly and evenly distributes any loading on the membrane (thereby preventing point loads or stresses) and effectively reduce any tension on the diaphragm.

Once installed, the entire structure is impervious to expansion and contraction of the slabs during normal temperature fluctuations. In addition, the process according to the invention provides a far more secure and water-tight seal between the slabs, particularly for applications in which high hydrostatic heads of water are supported by the concrete foundation. As indicated above, it has also been found that the urethane foam reacts with existing water in the void areas of the waterstop (as part of a chemical reaction with the water) and expands to further seal the waterstop within the concrete joint. Thus, the injected foam prevents the water from "tracking" behind the membrane to form a passageway around the waterstop at a failed location.

A particular advantage of the method and structure in accordance with the invention is that for new concrete installations, it altogether eliminates the need for using "bulb type" waterstops. As a result, it significantly reduces the overall cost of repair and/or installation by eliminating the labor costs associated with conventional waterstops. For example, the method according to the invention effectively eliminates the need to remove and replace existing concrete joints in order to repair a failed waterstop. The same process steps are utilized for new structures as in a repair operation. However, in new installations, the foam itself, rather than a waterstop, provides the necessary thermal expansion cushion between the void areas of the concrete slabs.

In addition to the advantages described above, the present waterstop construction enables the structure to be maintained and serviced after it has been installed. For example, a visible tear in the top part of the diaphragm may be repaired and the area around the repair injected with foam without requiring expensive and time consuming repairs to the remainder of the foundation.

One further discovery of the present invention concerns the use of the adhesive polyester (or other polymer) adhesive strips as one component in the structure applied to adjacent concrete panels. In prior repair methods, an epoxy gel was often used to anchor an elastic repair membrane to the joint opening. Such gels could not, however, be used in the method according to the present invention. If placed under compression (during, for example, the anchoring step), conventional epoxy gels tend to form sharp points and/or edges as the gel hardens (cures). If such gels were used in the repair structure of the present invention, the sharp points and edges could damage the diaphragm layer covering the concrete joint. Applicant has discovered that by saturating the felt with a "self-leveling" epoxy adhesive resin, the resin will be uniformly dispersed within the felt during the securing and anchoring step. Thus no sharp points or brittle areas form which might otherwise damage the neoprene-nylon diaphragm.

Accordingly, it is one object of the present invention to provide a method for repairing existing waterstops to prevent leakage of water in and around the void zones of the waterstop without requiring expensive concrete reconstruction and repair.

Another object of the present invention is to provide for an improved structure for new concrete foundations and structures which eliminates the need for utilizing conventional waterstops.

It is still a further object of the present invention to provide a membrane which serves the same function as a conventional waterstop and which consists primarily of a sealed and water-tight foam material injected between adjacent concrete slabs.

It is still a further object of the present invention to provide a new waterstop structure which is capable of accommodating the expansion, contraction and shearing forces generated by concrete slabs during wide temperature fluctuations.

It is still a further object of the present invention to provide a water-tight seal between foundation slabs which are subjected to high hydrostatic heads such as those in water reservoirs, storage tanks and the like.

It is yet another object of the present invention to provide a more effective and reliable waterstop construction which can be used for concrete joints subjected to both positive and negative head pressures.

These and other objects of the present invention will appear from the following description of the claims, reference being made to the accompanying drawings as part of the specification wherein like reference numerals designate corresponding parts in different respective views.

DETAILED DESCRIPTION OF THE DRAWINGS

Figure 1:
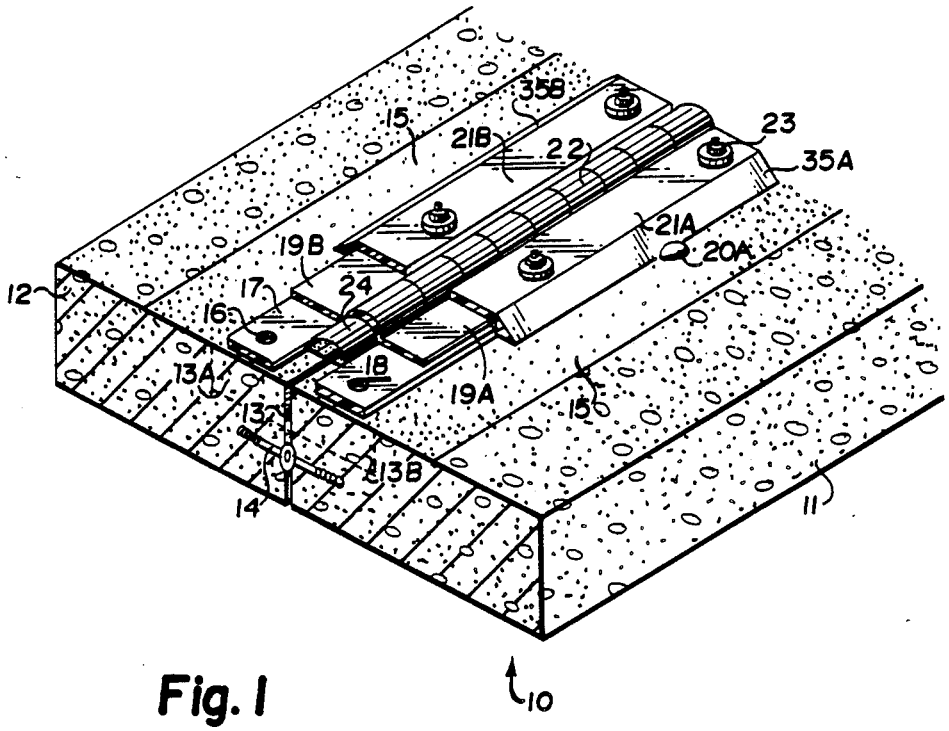
FIG. 1 is a perspective view, taken partly in cross section, showing an assembled waterstop structure in accordance with the present invention.

With particular reference to FIG. 1 of the drawings, a waterstop repair structure in accordance with the present invention is shown generally at 10. The existing waterstop 14 is positioned between adjacent concrete slabs 11 and 12, with a previously-installed joint board located above and below the waterstop and between the slabs (shown as item 13).

As the first step in the method according to the invention, all unsound concrete in the areas designated to receive the waterstop repair are cleaned by way of high-pressure water blasts, sand blasts or mechanical scarification. As FIG. 1 illustrates, the clean concrete surface (shown generally as cross-hatched area 15) extends laterally across the concrete surfaces and includes an area sufficient for purposes of installing the felt adhesive strips, neoprene-nylon diaphragm member and polymer nosing.

After the cleaning operation, a series of anchoring holes 16 are drilled on each side of concrete slabs 11 and 12. For convenience, a fiberglass template (item 26 on FIG. 2) may be used to position and drill the anchor holes. For most applications, it has been found that one-fourth inch diameter holes 16 are sufficient for the stainless steel expansion anchors, although the size will vary depending on the particular application. The anchors themselves (shown as 29 on FIG. 5) secure the entire waterstop repair structure to the concrete surfaces on each side of the adjacent concrete slabs. After the anchor holes are drilled, three-eighth inch diameter "grout holes" 20 are drilled along both sides of concrete slabs 11 and 12 at a distance of approximately every 10 feet, depending on field conditions. Ultimately, the grout holes will provide a means for injecting the hydrophilic urethane foam composition into the void areas of the adjacent concrete panels 11 and 12. Typically, the grout holes are drilled along a diagonal line relative to the planar surface of the concrete to thereby intercept the joint opening between the slabs at a desired depth below the concrete surface. For most applications, the point of intersection with the joint will be slightly above the position of the existing waterstop "bulb". However, under certain conditions and for certain types of repair operations, the grout holes may intersect the joint above, below or on both sides of the waterstop and may originate from one or both sides of the adjacent concrete panels.

The grout holes and diagonal shaft portions of the holes are depicted on FIG. 1 by way of example as items 20, and 25, respectively. After the diagonal holes 20 have been drilled, they must be carefully examined to ensure that the connection with the concrete joint is made at each desired location. Thereafter, the grout holes are temporarily plugged in order to prevent debris from entering the holes until the point when the urethane foam is injected.

After the diagonal grout holes 20 (foam access holes) are drilled and checked, all of the dust generated by the drilling operation is carefully removed and polyester felt adhesive strips (items 17 and 18 on FIG. 1) are placed into position on opposite sides of the concrete slabs. A conventional two-component "self leveling" epoxy adhesive is then poured onto the polyester felt until the felt becomes saturated. As indicated above, the polyester felt acts as a sponge for the adhesive and creates a uniformly-soaked membrane upon which the neoprene-nylon member may be fastened. After the resin adhesive strips have been soaked, reinforced neoprene membrane 22 is placed over the top of polyester felt resin adhesive strips 17 and 18. Structurally, the neoprene diaphragm consists of a single piece, nonwoven neoprene-nylon material having a protruding flexible center membrane portion 22A and flat side members 19A and 19B. Initially, neoprene diaphragm 22 is prepared for installation by wiping its lower surface with a suitable cleaning solvent to ensure a clean, dry contact surface. Once in position over the top of the polyester felt strips, fiberglass hold-down bars 21A and 21B are placed over the diaphragm. Stainless steel expansion anchors (shown by way of example on FIG. 1 as item 23) are placed into the pre-drilled one-fourth inch diameter holes and the entire structure is tightened until excess resin from the soaked polyester felt oozes from the diaphragm/concrete interface. During the anchoring step, all intersecting joints will thereby be protected by a fully bonded diaphragm utilizing the two-component epoxy adhesive.

After the fiberglass hold-down bar/neoprene diaphragm assembly is anchored in place, hydrophilic urethane foam is injected underneath the diaphragm into the concrete joint. Typically, a grout hose (shown as item 33 on FIG. 6) is positioned inside each grout opening 20 and the foam is injected under pressure in a step-wise manner from one end of the joint, to the other at the various pre-drilled grout access openings 20. For most concrete foundations, the foam may be injected on 10 foot centers on both sides of the concrete joint. However, it must be pumped at sufficient pressure to ensure full penetration of the entire joint cavity. The injected foam (shown in cross section as item 24 in FIG. 1) chemically reacts with any existing water in the void areas, thereby expanding and further ensuring a water-tight seal in and around the failed waterstop.

Once the foam injection is completed, polymer nosings 35A and 35B are installed on each side of the concrete joint. As with the neoprene-nylon membrane, the underside surfaces of the nosings must be cleaned with an appropriate solvent cleaning fluid prior to installation. Grout hole 20 is then patched (as noted by reference numeral (20A in FIG. 1) as a final step in the repair method according to the invention.

FIG. 1 of the drawings also depicts an alternative embodiment of the method and waterstop repair structure in accordance with the invention in which the top surface of the concrete panels is recessed as shown in dotted-line form at 13A and 13B. That is, a rectangular section of concrete is removed from the top surface of each panel along the full length of the concrete joint. The entire waterstop structure described above (other than the polymer nosing) may then be installed in the recessed area (groove), with the bottom surface of the groove serving the same purpose as the top surface of the concrete panels.

Figure 2:
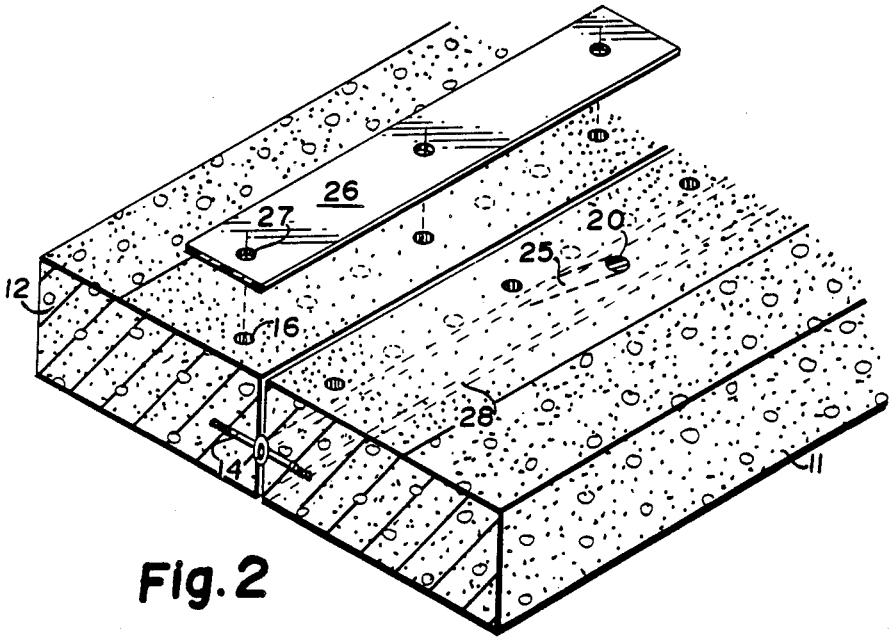
FIG. 2 is a perspective view of a typical prior art construction utilizing a conventional waterstop disposed between adjacent slabs of concrete and depicts the initial step of drilling holes in the concrete for the expansion anchors and the step of forming one or more diagonal "grout holes" in the joint opening.

With particular reference to FIG. 2 of the drawings, the orientation of the grout holes relative to the planar surface of concrete slabs 11 and 12 is shown at 25. The initial step of positioning and drilling the required anchor holes 16 for the repair assembly is accomplished by using template 26.

Figure 3:
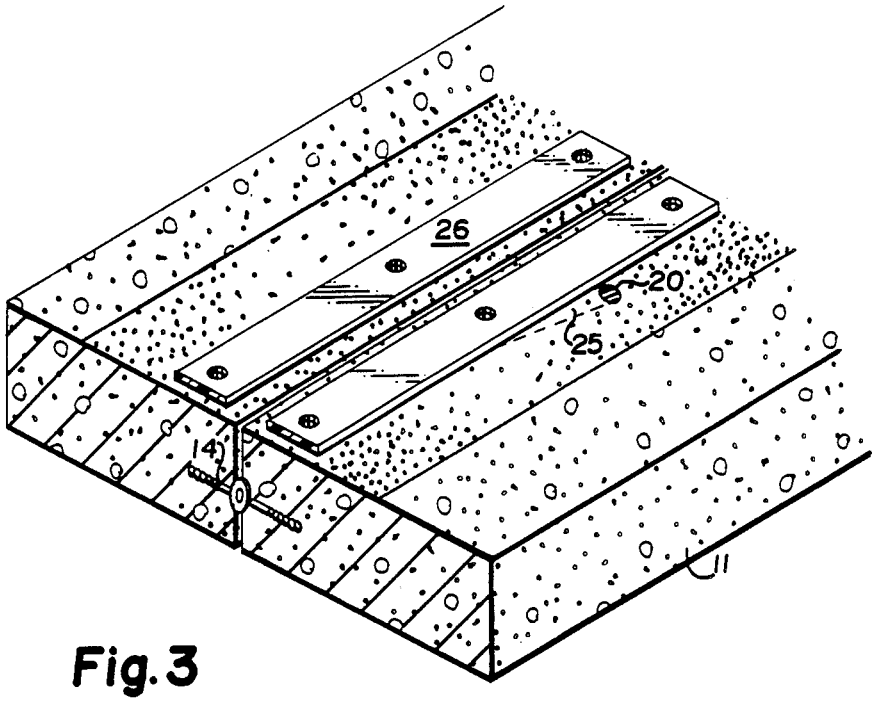
FIG. 3 illustrates the installation of the polyester felt adhesive strips and the saturation of the strips with a self-leveling epoxy adhesive.

FIG. 3 of the drawings further details the steps of installing the polyester adhesive felt strips 17, 18 which are then soaked with a self-leveling epoxy adhesive. As indicated above, in prior known methods of repair, an epoxy gel could conceivably be used to secure a protective covering over a concrete joint. However, because the water-tight integrity of membrane 22 must be maintained at all times, such gels could not be used in accordance with the present invention because they tend to form sharp bristles and points at the edges after the assembly is anchored into position. Such sharp edges could easily puncture or otherwise damage the neoprene member. Thus, the use of epoxy-soaked polyester felt adhesive strips avoids the possibility of damage to the neoprene member during or after installation. Because the adhesive compound is "self-leveling" in nature, the felt strips soak up adhesive in a sponge-like manner and uniformly disperse the epoxy without forming sharp points or protrusions.

Figure 4:
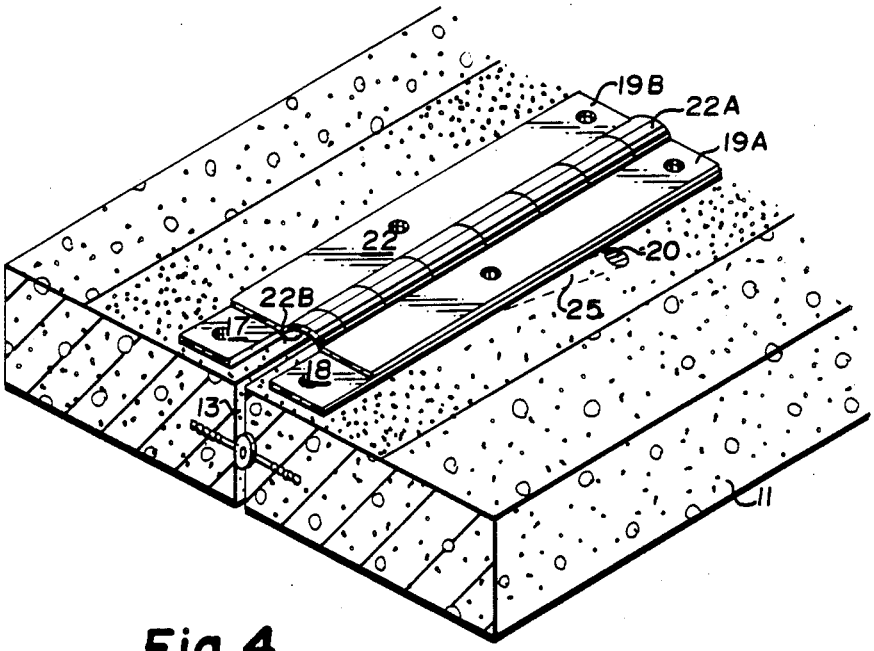
FIG. 4 is a perspective view showing the installation of the neoprene diaphragm by solvent wiping contact with the adhesive strips.
Figure 5:
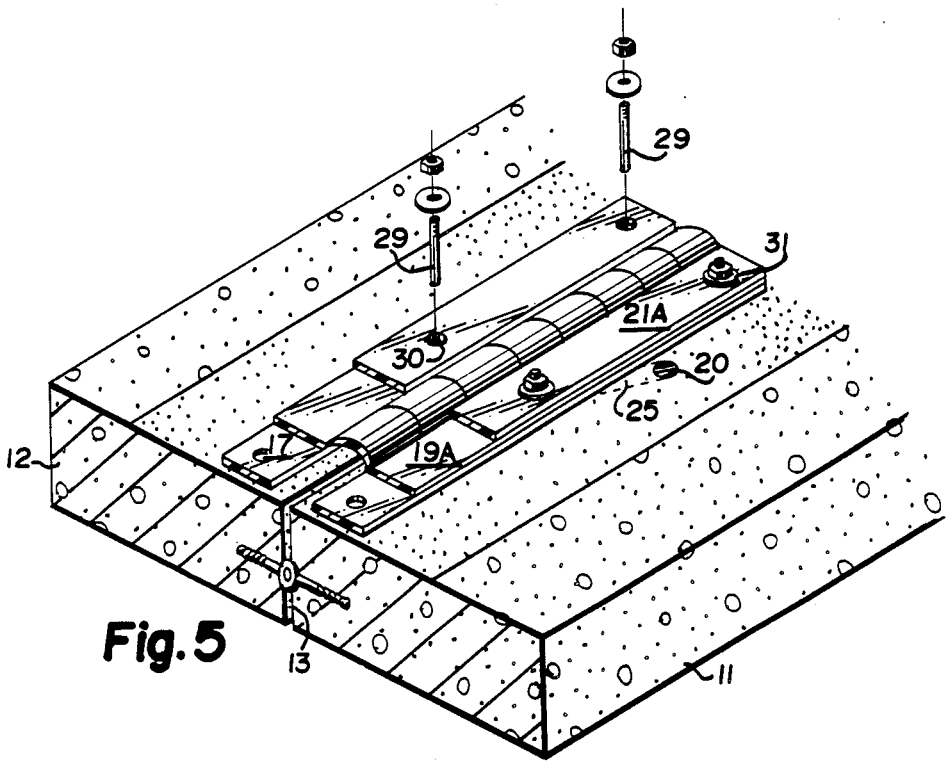
FIG. 5 shows the step-wise installation of the neoprene diaphragm by utilizing steel expansion anchors in the pre-drilled anchor holes.

FIG. 4 of the drawings shows the steps of securing the diaphragm member 22 to the polyester felt strips 17 and 18, in which the underside portions of the diaphram member 22 are first cleaned by solvent wiping contact with an appropriate cleaning solvent, particularly flat edges 19A and 19B thereof. As is also seen in FIG. 4, the diaphragm member 22 has a center membrane portion 22A between its edges 19A and 19B. Center membrane portion 22A covers joint 13 and establishes therebelow a region 22B in communication with joint 13. FIG. 5 depicts the step of installing the fiberglass hold-down bars 21A and 21B over the neoprene member using anchor bolts 31. Typically, such anchoring bolts consist of a threaded bolt portion 29 sized for insertion in anchor holes 30 in the fiberglass hold-down bars.

Figure 6:
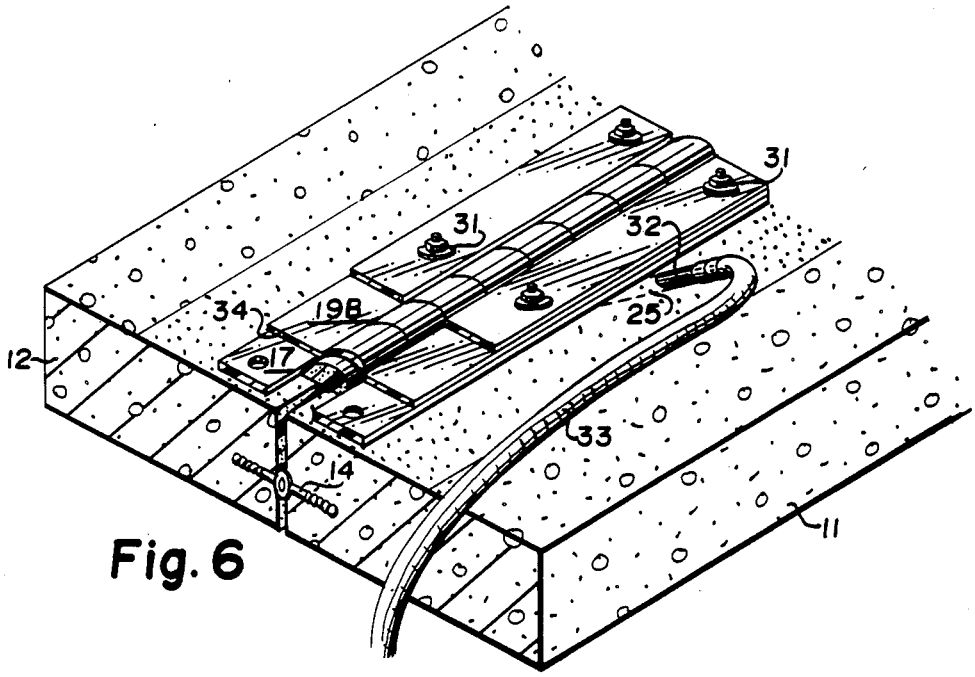
FIG. 6 shows the step-wise insertion of hydrophilic urethane foam into the concrete joint through the pre-drilled "grout holes".

FIG. 6 of the drawings shows the step of injecting urethane foam under pressure into the grout holes (shown by way of example as item 25) using an injection hose 33. FIG. 6 also shows, injected foam 34 filling the region 22B (see FIG. 4) below the center membrane portion 22A of diaphragm member 22 to thereby fill the void areas in the joint between concrete slabs 11 and 12 above the existing waterstop 13. Depending on the requirements of the repair in question, however, the foam could also be injected at various locations both above and below the waterstop to further ensure a water-tight structure.

Figure 7:
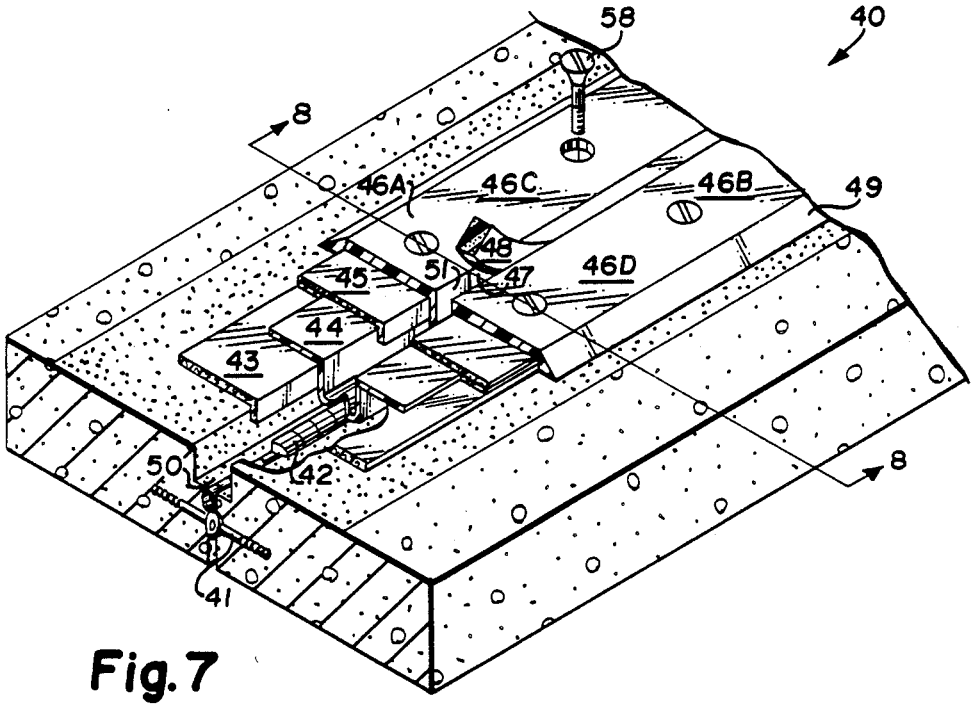
FIG. 7 is a perspective view, taken partly in cross section, showing an alternative embodiment of an assembled waterstop structure in accordance with the present invention.
Figure 8:
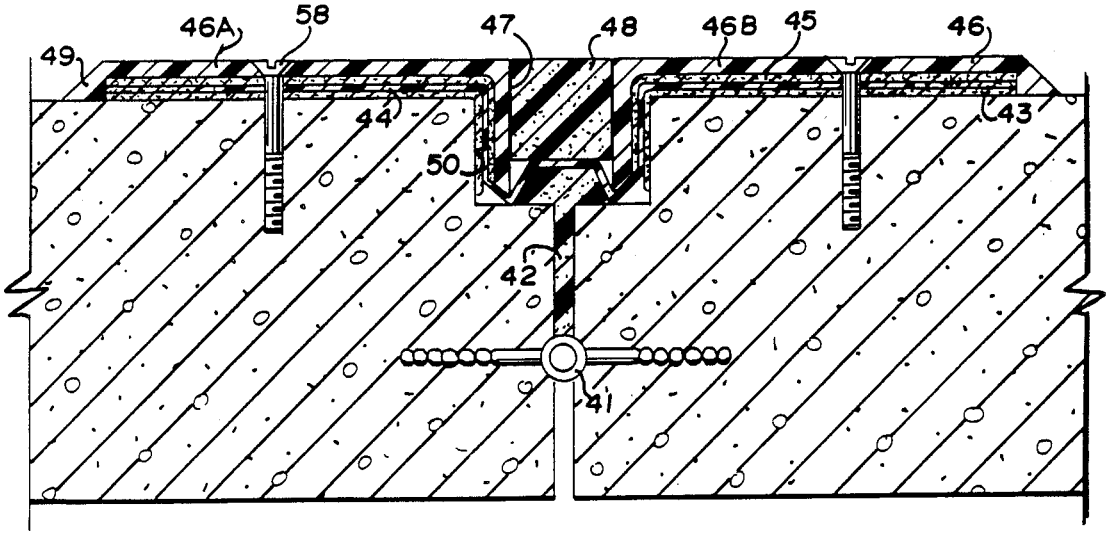
FIG. 8 is a section view taken along line 8—8 of FIG. 7.

FIGS. 7 and 8 of the drawings depict an alternative embodiment of the present invention with the assembled waterstop shown generally at 40. Unlike the previous embodiment, the area defined by the top portion of the concrete joint is modified prior to installation of the waterstop structure. Initially, a groove (shown at 50) is formed between the joints sufficient in size to receive the waterstop repair structure. Typically, the grooves may be formed by making a sawcut along the top edge portion of each joint and, preferably, the cut should be made to a depth of about two and one-half inches. However, the exact depth will vary depending on the application in question. The section of concrete between the cut edges is removed and the groove and top surfaces sandblasted to provide a roughened surface which will readily adhere to the adhesive compound in the polyester felt strips. One or more angled grout holes are also drilled into the concrete surface on both sides of the joint for purposes of the foam injection as described above.

A first polyester felt adhesive strip 43 is installed in groove 50 such that the top portions extend over the top surfaces of the groove as shown in FIG. 8. Once in position, the soaked adhesive strip fills any small holes and surface defects with adhesive compound. A perforated (as opposed to solid-piece) neoprene-nylon diaphragm member 44 is then draped over the top of adhesive felt strip 43. Diaphragm 44 is sized to substantially conform to the inside surfaces of groove 50. Care should be taken to provide enough diaphragm material in the slot to allow for future joint movement without placing the diaphragm under tension. That is, enough material must be used such that the membrane will follow the contour of the preformed groove and yet have sufficient flexibility to move in its cradled position. Care must also be taken not to permit any adhesive compound to cover the non-contact surfaces of the neoprene diaphragm in the center portion of the groove. After the neoprene diaphragm is draped into position, it should be manually adjusted and worked into the adhesive felt strip to thereby remove air pockets and wrinkles and to force adhesive compound up through the perforations. The careful positioning of the diaphragm in that manner will ensure a tight adhesive seal between the diaphragm and the remaining waterstop structure.

A second adhesive felt strip 45 is placed over the top of diaphragm 44 and is sized to fit in precise registry with fiberglass hold-down bars 46A and 46B. Unlike the previous embodiment, however, fiberglass hold-down bars 46A and 46B consist of top flange portions 46C and 46D which contact the top surfaces of the neoprene diaphragm 43 as well as side portions (shown generally as 51) disposed at right angles to the flange portions for insertion into groove 50. Thus, the hold-down bars fit directly over the neoprene member and contact the sides of the second adhesive felt strip without necessarily contacting the center portion of the neoprene diaphragm. In installing the hold-down bars, the distance between the bars can be carefully controlled by, for example, the use of a temporary spacer block which can be removed after the bars are installed and secured into position.

Once the hold-down bars are in position, anchor holes are drilled into the concrete along both sides of the joint and the entire structure secured into position using anchor bolts 58 in the manner described above. Thereafter, a hydrophilic foam material is injected below diaphragm 44 as shown at 42. Again, the foam material flows into all void areas in and around waterstop 41 to provide a cushion below diaphragm 44 and thereby ensures the uniform distribution of load forces on the center portion of the diaphragm.

The final step in the alternative embodiment depicted in FIGS. 7 and 8 is the cutting and installation of a gasket member consisting of a solid, closed-cell type foam material 48. The gasket may consist of any conventional preformed foam gasketing material such as ethylene vinyl acetate and is sized to fit over the top of diaphragm 44 in groove 50. Again, the foam may be adhesively bonded to the side of hold-down bars 46A and 46B (see 47), but no adhesive should be applied to the top of the diaphragm itself. In order to ensure that the foam piece comprises a single, integral structure, it may be spliced at the ends using known foam welding techniques and then tension tested. Finally, a polymer nosing is installed on both sides of the fiberglass hold-down bars as previously described.

Although the method of repair and the waterstop products described herein represent a presently preferred exemplary embodiment of the present invention, those skilled in the art will recognize that many variations may be made without departing from the scope of the invention and thus that the invention is not necessarily limited to the embodiment shown in the drawings and described in the specification.

What is claimed is:

1. A water-sealed joint defined between a pair of structural elements comprising:

a flexible diaphragm member having side edges disposed on respective surfaces of said pair of structural elements in covering relationship to said joint such that a center portion of said diaphragm member, between said side edges thereof, defines therebelow a region in communication with said joint;

anchor means for anchoring said side edges of said diaphragm member to said respective surfaces of said structural elements laterally of said joint;

an access opening defined by at least one of said structural elements, said opening intersecting said joint at a location below said region defined by said center portion of said diaphragm member and extending from said location to another location on said respective surface of said at least one structural element laterally of said anchor means;

a water sealant collectively filling said joint, said region defined below said center portion of said diaphragm member, and said access opening, whereby said joint is water sealed.

2. A sealed joint as in claim 1, wherein said structural elements are each concrete panels.

3. A sealed joint as in claim 1, wherein said anchor means includes epoxy-saturated felt strips between each of said side edges of said diaphragm member and said respective surfaces of said structural elements.

4. A sealed joint as in claim 3, wherein said anchor means includes a pair of hold-down bars rigidly secured to said respective surfaces of said structural elements over said felt strips.

5. A method of water-sealing a selected portion of a joint defined between a pair of structural members comprising the steps of:

(a) laying a flexible diaphragm member on respective surfaces of said structural members so that said diaphragm covers said selected joint portion, and such that a center portion of said diaphragm member establishes therebelow a region in communication with said covered selected joint portion;

(b) anchoring at least side edges of said diaphragm member to said respective surfaces of said structural members;

(c) forming at least one access opening in one of said structural members which intersects said joint at a location below said region established by said center portion of said diaphragm member and extends therefrom to a location on said respective surface of said one structural member laterally of said joint; and then (d) injecting a foamable water sealant into said at least one access opening and allowing said sealant to foam sufficiently to fill said selected joint portion and said region established below said center portion of said diaphragm member, whereby said selected joint portion is water-sealed.

6. A method as in claim 5, wherein step (b) is practiced by interposing uncured epoxy-saturated felt strips between each of said side edges of said diaphragm member and said respective surfaces of said structural members, and allowing said epoxy-saturated felt strips to cure.

7. A method as in claim 6, wherein step (b) is further practiced by anchoring hold-down bars over said diaphragm side edges so as to anchor said side edges and said epoxy-saturated felt strips to said respective surfaces of said structural members.

8. A method as in claim 5, wherein step (c) is practiced by drilling at least one diagonal access hole which intercepts said joint below said established region and which has an opening on said respective surface of said one structural member which is lateral to a respective side edge of said diaphragm member.

9. A method as in claim 5, wherein prior to step (a) there is practiced the step of forming a groove in said pair of structural members such that said respective surfaces thereof form a bottom of said groove.

10. A method as in claim 5, wherein step (c) is practiced by forming a plurality of access openings in one and/or the other of said structural members.

11. A method for repairing a failed waterstop in a joint defined between adjacent concrete panels of a concrete structure so as to reestablish waterstop capability at said joint, said method comprising the steps of:

applying at least a pair of felt strips to respective top surfaces of said concrete panels laterally of the joint therebetween;

applying an uncured epoxy adhesive to said felt strip;

installing a diaphragm member over said concrete joint such that side edges of said diaphragm member are positioned laterally of the joint in contact with said uncured epoxy adhesive applied to said felt strips, and such that a central membrane portion of said diaphragm member, between said side edges thereof, is positioned above the joint and defines therebelow a region in communication with the joint, and allowing said epoxy adhesive to cure so as to bond said side edges of said diaphragm member to respective said surfaces of said concrete panels;

anchoring said felt adhesive strips and said side edges of said diaphragm member to said concrete panels; and injecting hydrophilic foam into said joint between said concrete panels and beneath said diaphragm member, wherein said step of injecting said hydrophilic foam includes, (i) forming at least one foam access opening in at least one of said adjacent concrete panels so that said opening intersects the joint at a location below said region defined by said central membrane portion of said diaphragm member and extends therefrom to a location on said top surface of said at least one concrete panel laterally of the joint, and (ii) injecting said hydrophilic foam into said access opening at said location thereof on said top surface of said at least one concrete panel sufficient to allow said foam to fill said joint and said region defined by said central membrane portion of said diaphragm member in communication therewith, whereby waterstop capability at said joint is reestablished.

12. A method according to claim 11 further comprising the step of cleaning said top surfaces of said concrete panels to remove unsound concrete before applying said felt adhesive strips.

13. A method according to claim 11 further comprising the step of installing fiberglass hold-down bars over said side edges of said diaphragm member before anchoring said felt adhesive strips and said side edges of said diaphragm member to said concrete panel.

14. A method according to claim 13 further comprising the step of securing polymer nosings on each side of said hold-down bars after anchoring said felt adhesive strips and said side edges of said diaphragm member to said concrete panels.

15. A method according to claim 11 wherein said hydrophilic foam consists of urethane foam.

16. A method according to claim 11, wherein said diaphragm member comprises a neoprene elastomer having a nylon fabric impregnated therein.

17. A method according to claim 11, wherein said concrete structure is of the type having an existing waterstop disposed in the joint, and wherein said step of injecting said hydrophilic foam is by forming said at least one access opening such that it intersects the joint at a location below said existing waterstop, and then injecting the foam through said access opening so that it enters the joint below said existing waterstop in said concrete joint.

18. A method of installing a waterstop in a joint defined between adjacent concrete panels of a concrete structure, said method comprising the steps of:

installing felt adhesive strips on respective top surfaces of said concrete panels laterally adjacent said joint defined therebetween;

applying an uncured epoxy adhesive to said felt adhesive strips;

installing side edges of a diaphragm member over said felt adhesive strips such that a center membrane portion of said diaphragm member, between said side edges, extends over said joint and establishes a region therebelow in communication with the joint, and allowing said epoxy adhesive to cure so as to adhesively bond said side edges of said diaphragm member to respective said surfaces of said concrete panels;

installing fiberglass hold-down bars over said side edges of said diaphragm member;

anchoring said felt adhesive strips, said side edges of said diaphragm member, and said fiberglass hold-down bars to said concrete panels; and injecting hydrophilic foam into said joint between said concrete panels and beneath said diaphragm member, wherein said step of injecting hydrophilic foam includes the steps of, (i) forming at least one foam access opening in at least one of said adjacent concrete panels so that said opening intersects said joint at a location below said defined region and extends therefrom to a location on said top surface of said at least one concrete panel laterally of said joint, and (ii) injecting said hydrophilic foam into said access opening at said location thereof on said top surface of said at least one concrete panel sufficient to allow said foam to fill said joint and said defined region in communication therewith, whereby a watertight seal is formed at said joint.

19. A method according to claim 18 further comprising the step of securing polymer nosing to said concrete panels on each side of said fiberglass hold-down bars.

20. A method according to claim 18 further comprising the step of cleaning said top surfaces of said concrete panels to remove unsound concrete before applying said felt adhesive strips.

21. A method according to claim 18 wherein said hydrophilic foam consists of urethane foam.

22. A method of installing a waterstop in a joint defined between adjacent concrete panels of a concrete structure, said method comprising the steps of:

removing a portion of said concrete panels along a surface thereof to define a recessed groove along said joint;

applying felt adhesive strips to respective surfaces of said recessed groove;

applying an uncured epoxy adhesive to said felt adhesive strips;

installing side edges of a diaphragm member over said felt adhesive strips in said recessed grove such that a center membrane portion of said diaphragm member, between said side edges thereof, extends over said joint and establishes a region therebelow in communication with said joint, and allowing said epoxy adhesive to cure so as to bond said side edges of said diaphragm member to respective said surfaces of said concrete panels;

anchoring said felt adhesive strips and at least said side edges of said diaphragm member to said concrete panels laterally of said joint; and injecting hydrophilic foam into said joint between said concrete panels and beneath said diaphragm member, wherein said step of injecting hydrophilic foam includes the steps of, (i) forming at least one foam access opening in at least one of said adjacent concrete panels so that said opening intersects said joint at a location below said region established by said center membrane portion and extends therefrom to a location on said top surface of said at least one concrete panel laterally of said joint, and (ii) injecting said hydrophilic foam into said access opening at said location thereof on said top surface of said at least one concrete panel sufficient to allow said foam to fill said joint and said region established by said center membrane portion of said diaphragm member in communication therewith, whereby a waterstop is formed at said joint.

23. A method according to claim 22 further comprising the step of installing fiberglass hold-down bars over said side edges of said diaphragm member before anchoring said felt adhesive strips and at least said side edges of said diaphragm member to said concrete panels.

24. A waterstop disposed in a joint defined between adjacent concrete panels comprising:

absorbent material disposed on top surfaces of said adjacent concrete panels laterally adjacent the joint defined between said concrete panel;

cured epoxy adhesive dispersed in said absorbent material;

a diaphragm member having side edges disposed on top of said absorbent material and bonded thereto by means of said cured epoxy adhesive, and wherein said diaphragm member includes a center membrane portion between said side edges thereof covering said joint so as to establish therebelow a region in communication with said joint;

anchoring means for anchoring said absorbent material and said side edges of said diaphragm member to said concrete panels;

at least one access opening formed in at least one of said concrete panels, said at least one access opening intersecting said joint at a location below said region established by said center membrane portion and extending therefrom to a location on said top surface of said at least one concrete panel laterally of said joint; and a foam seal filling (i) said joint between said concrete panels, (ii) said region established below said center membrane portion of said diaphragm member, and (iii) said at least one access opening, thereby forming said waterstop in said joint.

25. A waterstop in accordance with claim 24 further comprising fiberglass hold-down bars disposed over said side edges of said diaphragm member.

26. A waterstop in accordance with claim 25 further comprising polymer nosings disposed along longitudinal edges of said fiberglass hold-down bars.

27. A waterstop in accordance with claim 24 wherein said foam cushioning consists of urethane foam.

28. A waterstop in accordance with claim 24 wherein said diaphragm comprises neoprene elastomer having nylon fabric imbedded therein.

29. A method for repairing a failed waterstop in a joint defined between adjacent concrete panels in a concrete structure whereby said method reestablishes waterstop capability to said joint and comprises the steps of;

forming a groove in the top portion of said joint;

installing a first pair of adhesive felt strips in said groove along respective lateral sides of said joint;

installing side edges of a diaphragm member over said first pair of adhesive strips and in said groove such that a center membrane portion of said diaphragm member, between said side edges thereof, covers said joint so as to establish therebelow a region in communication with said joint;

installing a second pair of adhesive strips over said side edges of said diaphragm member and in said groove;

anchoring said first and second pairs of felt adhesive strips and at least said side edges of said diaphragm member to said concrete panels;

injecting hydrophilic foam beneath said joint between said concrete panels and beneath said diaphragm member; and installing foam gasket means over said diaphragm member in said groove, wherein said step of injecting hydrophilic foam includes the steps of, (i) forming at least one foam access opening in at least one of said adjacent concrete panels so that said opening intersects said joint at a location below said groove and extends therefrom to a location on a top surface of said at least one concrete panel laterally of said joint, and (ii) injecting said hydrophilic foam into said access opening at said location thereof on said top surface of said at least one concrete panel sufficient to allow said foam to fill said joint and said region defined by said central membrane portion of said diaphragm member in communication therewith, whereby waterstop capability is reestablished at said joint.

30. A waterstop joint between adjacent concrete panels comprising:

a first absorbent adhesive compound disposed on respective top surfaces of said concrete panels laterally of said joint therebetween;

a diaphragm member having side edges which are disposed on top of said first absorbent adhesive material and also having a center membrane portion, between said side edges thereof, covering said joint thereby establishing therebelow a region in communication with said joint;

a second absorbent adhesive material disposed on top of said side edges of said diaphragm member;

a pair of hold-down bars disposed on top of said second absorbent adhesive material laterally of said joint;

anchoring means for anchoring said first and second absorbent adhesive materials, said hold-down bars, and said side edges of said diaphragm member to said concrete panels;

at least one access opening formed in at least one of said concrete panels, said at least one access opening intersecting said joint at a location below said region established by said center membrane portion and extending therefrom to a location on a top surface of at least one of said concrete panels laterally of said joint; and a foam seal filling (i) said joint between said concrete panels, (ii) said region established below said center membrane portion of said diaphragm member, and (iii) said at least one access opening, thereby forming said waterstop in said joint.

* * * * *